US007270191B2

(12) United States Patent
Drummond et al.

(10) Patent No.: US 7,270,191 B2
(45) Date of Patent: Sep. 18, 2007

(54) FLAPPER OPENING MECHANISM

(75) Inventors: Steven J. Drummond, Aberdeen (GB); Graham Farquhar, Turriff (GB)

(73) Assignee: Baker Hughes Incorporated, Houston, TX (US)

( * ) Notice: Subject to any disclaimer, the term of this patent is extended or adjusted under 35 U.S.C. 154(b) by 275 days.

(21) Appl. No.: 11/099,938

(22) Filed: Apr. 6, 2005

(65) Prior Publication Data

US 2005/0224234 A1 Oct. 13, 2005

Related U.S. Application Data

(60) Provisional application No. 60/560,152, filed on Apr. 7, 2004.

(51) Int. Cl.
*E21B 23/00* (2006.01)
*E21B 34/06* (2006.01)

(52) U.S. Cl. ..... 166/386; 166/332.8

(58) Field of Classification Search ..... None
See application file for complete search history.

(56) References Cited

U.S. PATENT DOCUMENTS

| | | | | |
|---|---|---|---|---|
| 4,122,898 A | | 10/1978 | Nelson | 166/325 |
| 4,813,481 A | * | 3/1989 | Sproul et al. | 166/51 |
| 5,044,443 A | * | 9/1991 | Churchman et al. | 166/386 |
| 5,137,090 A | | 8/1992 | Hare et al. | 166/325 |
| 5,323,859 A | | 6/1994 | Smith et al. | 166/321 |
| 6,125,930 A | * | 10/2000 | Moyes | 166/66 |
| 6,209,663 B1 | * | 4/2001 | Hosie | 175/57 |
| 6,263,910 B1 | | 7/2001 | Davis et al. | 137/516.27 |
| 6,705,593 B2 | | 3/2004 | Deaton | 251/303 |
| 2001/0007284 A1 | | 7/2001 | French et al. | 166/373 |
| 2001/0022194 A1 | | 9/2001 | Davis et al. | 137/527 |
| 2003/0121665 A1 | | 7/2003 | Trott et al. | 166/332.8 |

FOREIGN PATENT DOCUMENTS

| | | |
|---|---|---|
| WO | WO 01/36787 A1 | 5/2001 |
| WO | WO 03/080993 A1 | 10/2003 |

OTHER PUBLICATIONS

Baker Oil Tools, Packer Systems Technical Unit No. 10212, "Size 834×575 Full Bore Isolation Valve (FBIV)" (Oct. 28, 2004), 16 pages.

* cited by examiner

*Primary Examiner*—Frank Tsay
(74) *Attorney, Agent, or Firm*—Shawn Hunter

(57) ABSTRACT

Methods and devices for operation of a flapper valve. A valve assembly is described with a flapper element and a valve opening assembly that will mechanically open the flapper element. The valve opening assembly is particularly valuable where the flapper element fails to open in response to normal hydraulic opening techniques. The valve opening assembly includes a valve opening sleeve having a generally hemispherical cross-section and an opening portion that presents a pair of opening shoulders. The opening shoulders engage lugs on the flapper element so that movement of the opening sleeve will urge the flapper element to an open position. The valve assembly may be run into the wellbore with the flapper element in the open position, rather than having to be closed, as with a number of conventional valve assemblies.

16 Claims, 6 Drawing Sheets

FLAPPER OPENING MECHANISM

CROSS-REFERENCE TO RELATED APPLICATIONS

This application claims priority to U.S. Provisional Patent Application Ser. No. 60/560,152 filed Apr. 7, 2004.

BACKGROUND OF THE INVENTION

1. Field of the Invention

The invention relates generally to the design of flapper valves.

2. Description of the Related Art

A flapper valve is a plate-like member that is pivotally affixed to one side of the tubing string and may be rotated 90 degrees between an open position and a closed position. A spring member typically biases the flapper element toward its closed position. The flapper element is typically opened using hydraulic fluid pressure.

Flapper valves have a variety of downhole uses, including safety valves. In addition, flapper valves can be incorporated into fluid loss control valves and wellbore isolation valves. In such instances, the flapper valve is installed in an inverted position so that the flapper element opens by being pivoted upwardly (toward the opening of the well).

At times, it is necessary to reopen a flapper valve after it has been closed. However, if the hydraulic system for opening the flapper valve should fail, there is a lack of reliable backup means for opening the flapper element. In prior art techniques, a pipe or other tubular member is brought into engagement with the flapper element to push it off of its valve seat and rotate the valve member to its open position. An example of this is described in U.S. Pat. No. 6,705,593 issued to Deaton. However, this opening mechanism is not useful where the flapper element opens upwardly (i.e. toward the surface of the wellbore). In that case, urging a tubular member against the valve member would only force the valve assembly closed.

The present invention addresses the problems of the prior art.

SUMMARY OF THE INVENTION

The invention provides methods and devices for operation of a flapper valve. An exemplary valve assembly is described with a flapper element and a valve opening assembly that will mechanically open the flapper element. The valve opening assembly is particularly valuable where the flapper element fails to open in response to normal hydraulic opening techniques. In a described embodiment, the valve opening assembly includes a valve opening sleeve having a generally hemispherical cross-section and an opening portion that presents a pair of opening shoulders. The opening shoulders engage lugs on the flapper element so that movement of the opening sleeve will urge the flapper element to an open position. The valve assembly may be run into the wellbore with the flapper element in the open position, rather than having to be closed, as with a number of conventional valve assemblies.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

FIGS. 1, 1*a* through 6, 6*a* illustrate the construction and operation of an exemplary flapper valve assembly 10 in accordance with the present invention. The flapper valve assembly 10 is primarily useful as a fluid loss control valve, which can be run into a wellbore with a flapper element in either the open position or in the closed position. Secondarily, the flapper valve assembly 10 may be employed as an isolation valve, wherein the valve assembly is run with the flapper element in a closed position. Apart from the "valve opening assembly," and "opening sleeve," components, which are described below, the structure and function of the valve assembly 10 is the largely the same as that of the "Full Bore Isolation Valve," which is marketed commercially by Baker Oil Tools of Houston, Tex. The "Full Bore Isolation Valve" is fully described, for example, in Baker Oil Tools' Packer Systems Technical Unit No. 10212 (Oct. 28, 2004), which is incorporated herein by reference. This variety of valve is designed to provide isolation within a tubing string, holding pressure from both above and below when closed. Because the general details of construction and operation of this type of valve assembly are known to those of skill in the art, and otherwise available, they are not described in great detail herein.

Figure 1:
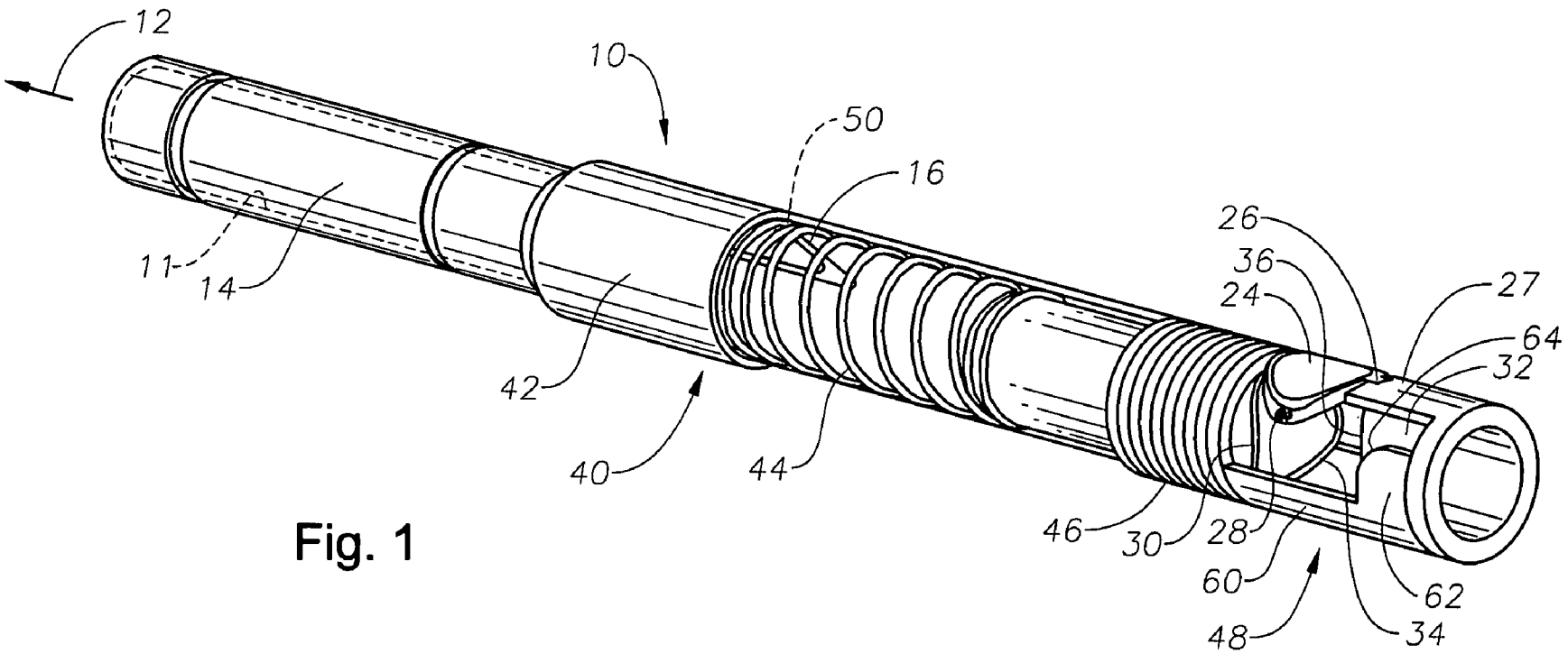
FIG. 1 is an isometric view of an exemplary flapper valve assembly constructed in accordance with the present invention in a run-in position.

The valve assembly 10 is typically incorporated into a production tubing string (not shown) of a type known in the art and disposed into a wellbore in a manner that is well understood by those of skill in the art. An axial flowbore 11 is defined along the length of the valve assembly 10. Those of skill in the art will recognize that a number of exterior housing sleeves are associated with the Full Bore Isolation Valve that are not depicted in FIGS. 1-6, in order to provide clarity to the drawings. The uphole direction during typical downhole operation is illustrated by arrow 12 in FIG. 1. Further, the valve assembly is shown in FIG. 1 to be in a "running-in" position, with the valve assembly 10 open to permit the passage of fluids and tubing or tools therethrough.

Figure 1A:
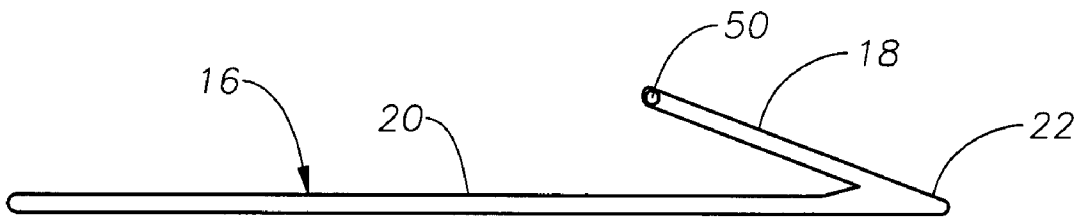
FIG. 1*a* is a detail drawing depicting configuration of a J-slot and lug assembly in the valve assembly shown in FIG. 1.
Figure 2:
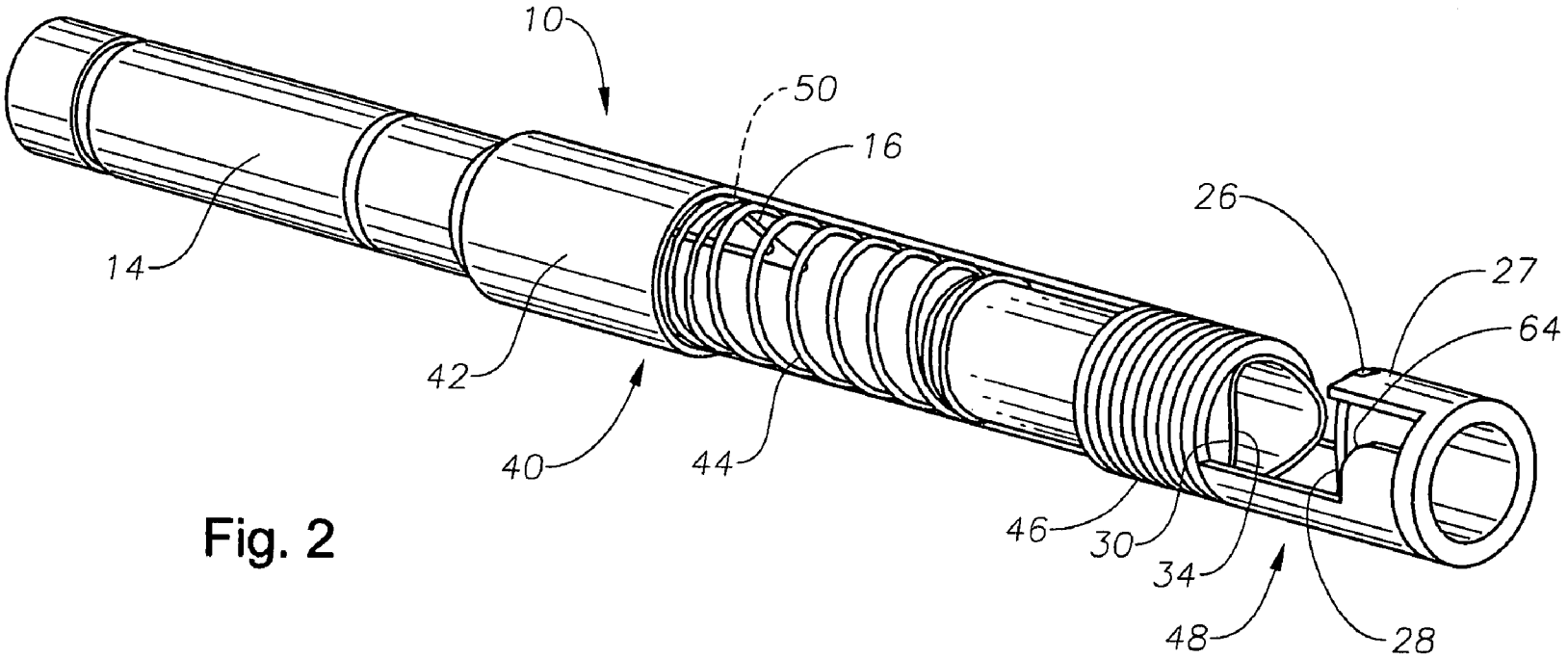
FIG. 2 is an isometric view of the valve assembly shown in FIG. 1, now with the flapper element closed.
Figure 2A:
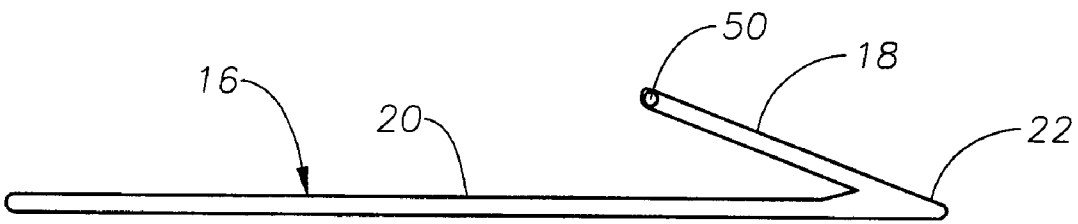
FIG. 2*a* is a detail drawing showing configuration of the J-slot and lug assembly.

The flapper valve assembly 10 includes a cylindrical central valve mandrel 14. The outer surface of the central valve mandrel 14 is inscribed with a lug pathway 16 of the type normally referred to as a "J-slot." The design of the lug pathway 16 is best seen in FIG. 1*a* to have a short leg portion 18 and a long leg portion 20 that are joined at an angular point 22.

The lower portion of the mandrel 14 is shown to reveal flapper element 24 that is secured by hinged attachment 26 to a hinge sleeve 27. The flapper element 24 is a curved plate having a first axial side 24*a* and a second axial side 24*b*. In FIG. 1, the flapper element 24 is in an open position. It is noted that the flapper element 24 has two side lugs 28 (one shown) that project outwardly from opposite edge surfaces of the flapper element 24. The central mandrel 14, with upper valve seat 30 profile, is shown retracted to accommodate the flapper element 24. The central mandrel 14 is designed to present a lower end face 34 that is shaped in a roughly sinusoidal manner to be generally complimentary to the curved shape of the first axial side 24*a* of the flapper element 24. Similarly, the lower valve seat 32 also presents a shaped end face 36 that also has a roughly sinusoidal shape to be generally complimentary to the underside 24*b* of the flapper element 24. The lower valve seat 32 is shown housed within the hinge sleeve 27.

A valve opening assembly, generally indicated at 40, radially surrounds the flapper element 24 and the central mandrel 14. The valve opening assembly 40 includes a trigger sleeve 42, a compression spring 44, a wicker thread and ratchet mechanism 46, and an opening sleeve 48.

The trigger sleeve 42 radially surrounds the lug pathway portion 16 of the central mandrel 14 and is axially moveable with respect to the central mandrel 14. The trigger sleeve 42 includes a radially inwardly projecting lug 50 that engages the lug pathway 16 and is moveable therewithin. It is pointed out that, although only one lug 50 and lug pathway 16 are shown, there might, in practice, be more than one lug 50 and lug pathway 16 associated with the valve assembly 10. When initially run in to the wellbore, as in FIG. 1, the lug 50 is located in the extreme end of the leg portion 18 of the lug pathway 16. Movement of the lug 50 within the lug pathway 16 will cause compression and release of a lower spring (not shown) in the wicker thread and ratchet mechanism 46, as is known in the art.

The compression spring 44 interconnects the trigger sleeve 42 with the wicker thread and ratchet mechanism 46 of a type known in the art. Opening sleeve 48 radially surrounds the lower portion 32 of the central mandrel 14 and is axially moveable with respect thereto. However, the opening sleeve 48 is affixed to the wicker thread and ratchet mechanism 46, which provides for incremental one-way motion between the opening sleeve 48 and the central mandrel 14. In this case, the mechanism 46 allows the opening sleeve 48 to move axially in the uphole direction 12 with respect to the mandrel 14, while the ratchet engagement prevents movement in the opposite direction. The opening sleeve 48 features a semicylindrical portion 60 and an opening portion 62 that extends approximately ¾ of the distance about the circumference of the lower portion 32. The opening portion 62 of the opening sleeve 48 presents a pair of rounded shoulders 64 (one shown).

When initially run into a wellbore, the flapper element 24 is in the open position shown in FIG. 1. A string of washpipe (not shown) is typically disposed within the central mandrel 14, extending downwardly through and into the lower portion 32 of the central mandrel 14. The flapper element 24 is held open by the presence of the washpipe at this time.

The washpipe is later removed from the central mandrel 14. When the washpipe is removed, the flapper element 24 closes (see FIG. 2) due to the spring bias of the torsion springs in the hinged attachment 26. Lugs 28 now align with the opening shoulders 64 of the opening sleeve 48.

Figure 3:
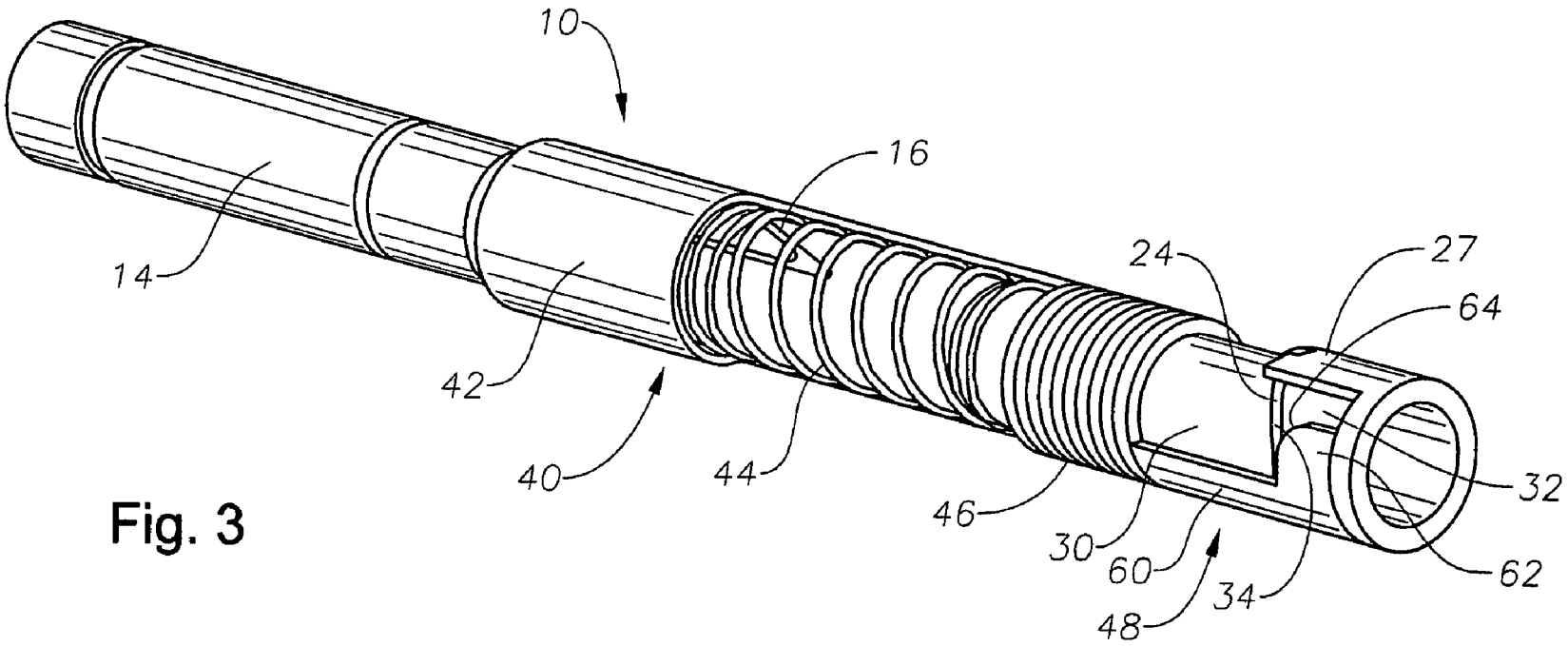
FIG. 3 is an isometric view of the valve assembly shown in FIGS. 1 and 2, now with the upper valve seat engaged with the flapper element.
Figure 3A:
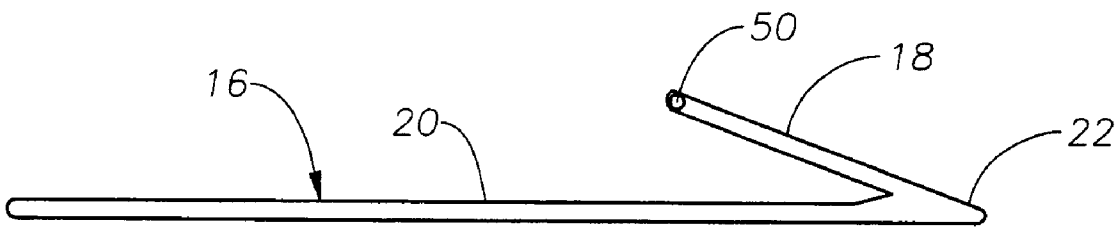
FIG. 3*a* is a detail depicting configuration of the J-slot and lug assembly in the valve assembly.

Fluid pressure is now increased within the production tubing string of which the valve assembly 10 is a part. The increased fluid pressure causes the central valve mandrel 14 to move down into contact with the flapper element 24, as illustrated in FIG. 3. At this point, the flapper element 24 is positively closed against fluid pressure differentials from either axial direction. Several cycles of pressure increases and decreases may now be accomplished within the tubing string and upper valve seat 30.

Figure 4:
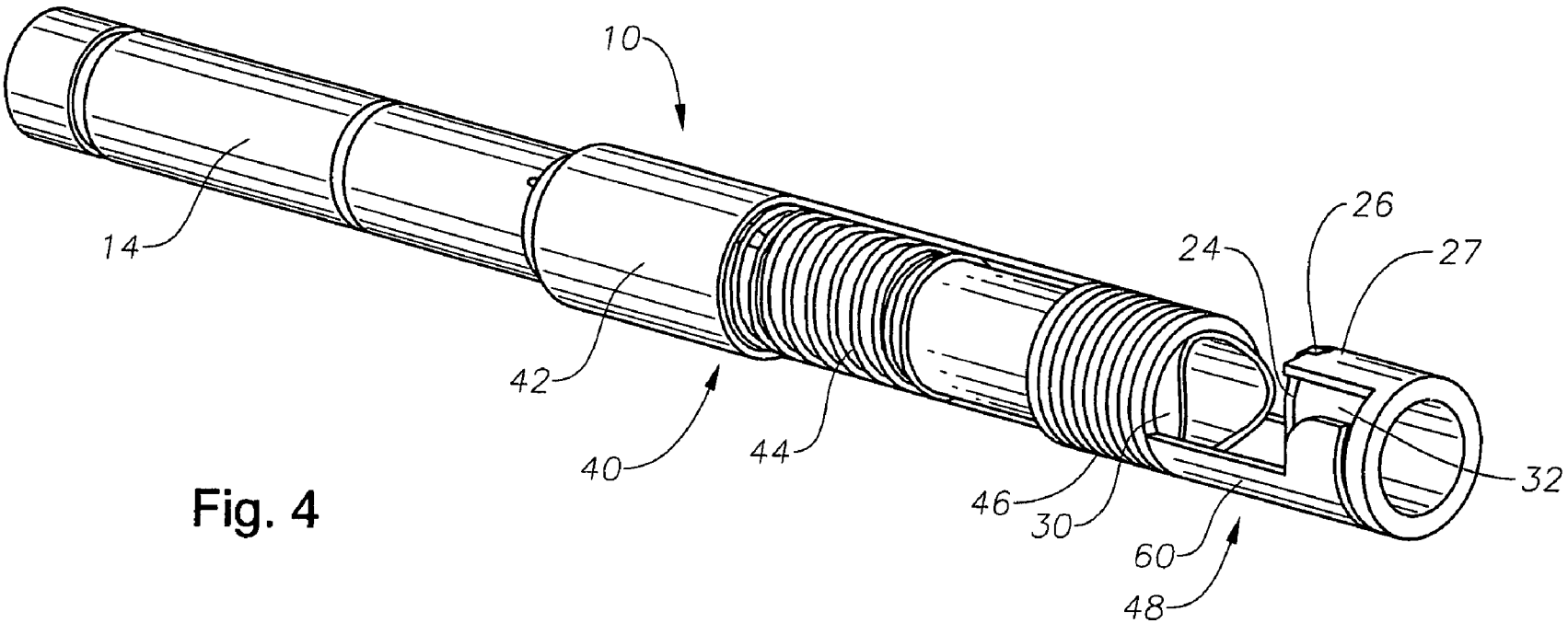
FIG. 4 is an isometric view of the valve assembly shown in FIGS. 1-3, now with the upper valve seat lifted off of the flapper element.
Figure 4A:
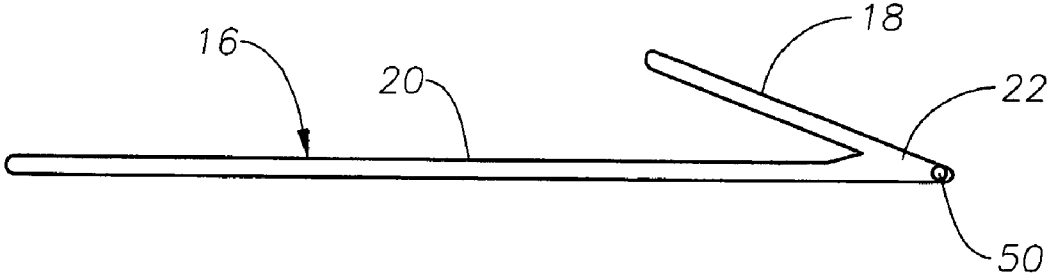
FIG. 4*a* is a detail drawing showing configuration of the J-slot and lug assembly.
Figure 5:
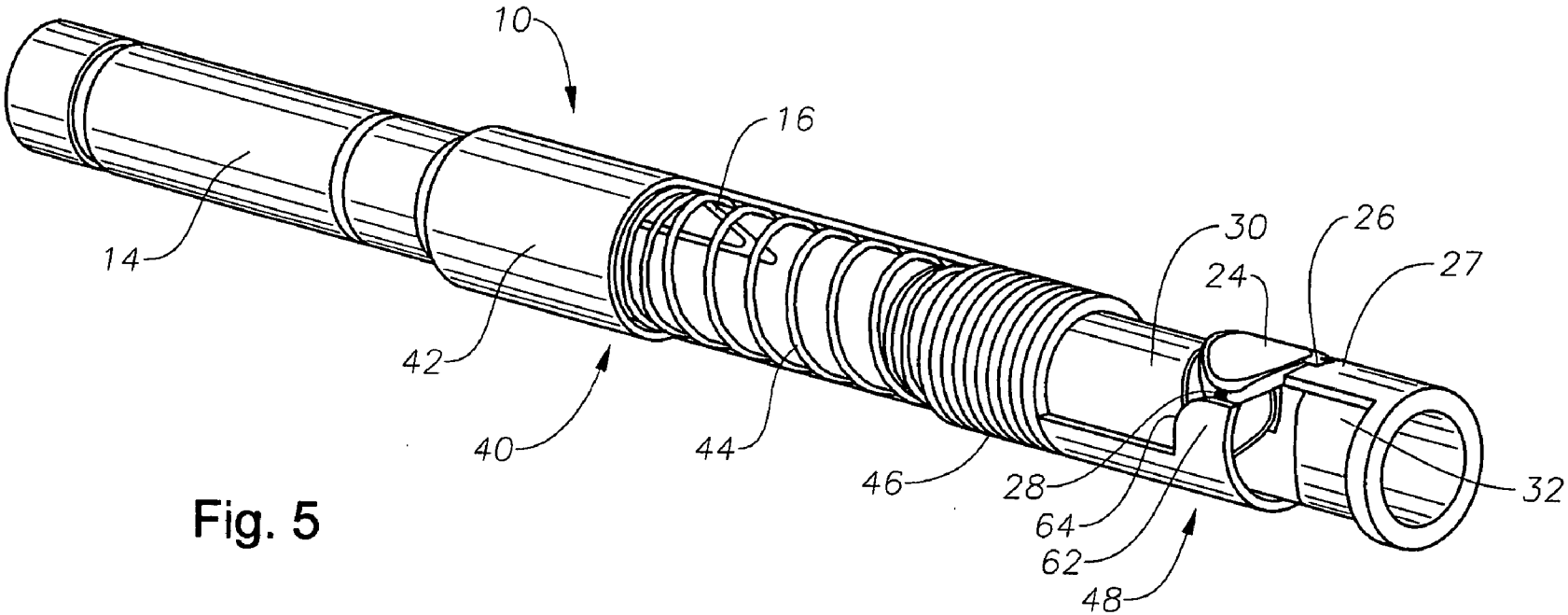
FIG. 5 is an isometric view of the valve assembly shown in FIG. 1, now with the flapper element open.
Figure 5A:
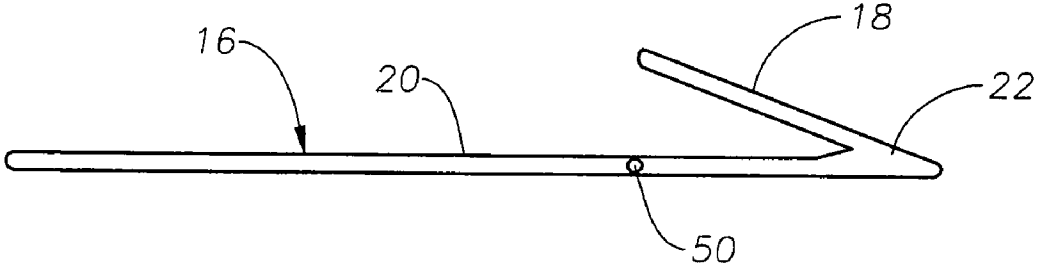
FIG. 5*a* is a detail drawing showing configuration of the J-slot and lug assembly.
Figure 6:
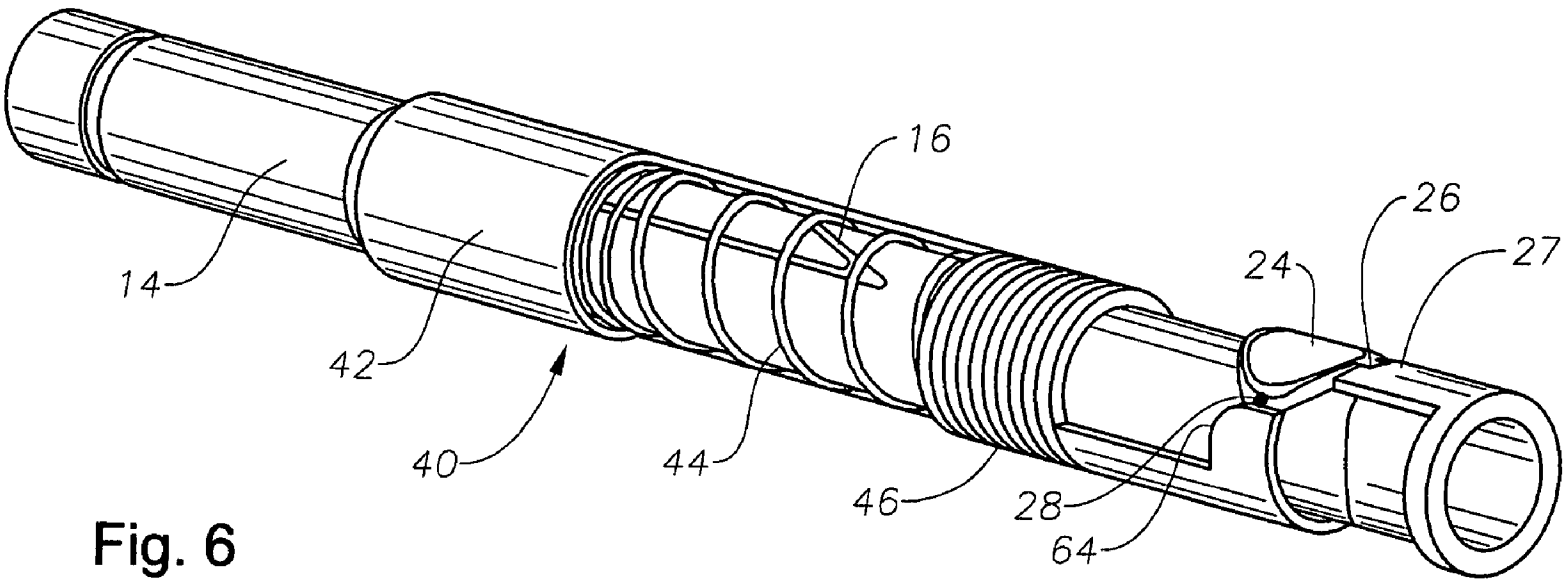
FIG. 6 is an isometric view of the valve assembly shown in FIG. 1, now with the flapper element being mechanically lifted off of the lower valve seat.
Figure 6A:
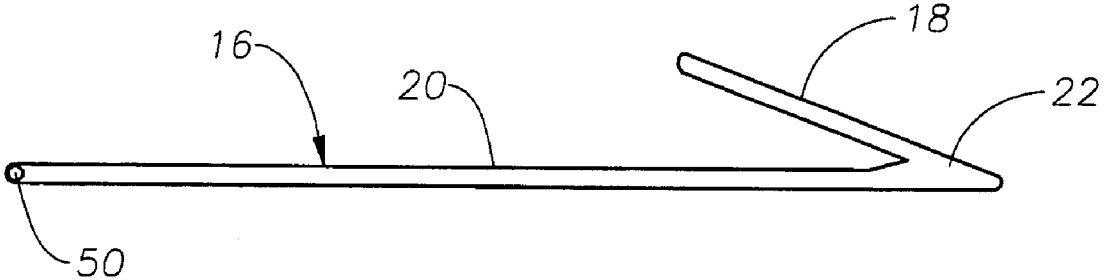
FIG. 6*a* is a detail drawing showing configuration of the J-slot and lug assembly.

To reopen the flapper element 24, completion of a specific number of pressure cycles is required to allow the lock ring (not shown) to become disengaged. The disengagement of the lock ring enables the central valve mandrel 14 with upper valve seat 34 to be lifted off of the flapper element 24, as FIG. 4 depicts. The flapper element 34 is now urged open by actuation of the valve opening assembly 40. The opening sleeve 48 is moved upwardly as the trigger sleeve 42 moves upwardly with respect to the central mandrel 14. As this occurs, the lugs 28 of the flapper element 24 ride upwardly upon the curved shoulders 64 of the opening sleeve 48 until the flapper element is in a fully open position (see FIG. 6). Thus, it can be seen that the use of the lug 50 and lug pathway 16 allows the spring 44 to be partially compressed during closing of the flapper element 24 and then fully compressed when the central valve mandrel 14 has been pumped open. Once the valve assembly 10 is vented, the energy stored in the spring 44 is released, allowing the flapper element 24 to be opened via the opening sleeve 48.

It is noted that the mechanical opening mechanism provided by the valve opening assembly 40 and the opening sleeve 48 may be used with flapper valve elements in other types of valve assemblies as well as the isolation valve 10 described herein.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. An opening assembly for a flapper-type valve member within a flowbore of a valve mandrel, wherein the valve member is moveable between an open position, wherein fluid can flow through the flowbore, and a closed position, wherein fluid flow through the flowbore is blocked, the opening assembly comprising:

a side lug projecting from an edge portion of the flapper-type valve member;

an opening sleeve that is moveable with respect to the valve mandrel, the opening sleeve having an engagement shoulder portion for contacting the lug and urging it to the open position.

2. The opening assembly of claim 1 further comprising a ratchet mechanism affixed to the opening sleeve to provide incremental one-way axial displacement of the opening sleeve with respect to the valve mandrel.

3. The opening assembly of claim 2 further comprising a trigger sleeve radially surrounding the central valve mandrel and operably associated with the ratchet mechanism.

4. The opening assembly of claim 3 wherein the trigger sleeve is operably associated with the ratchet mechanism by interconnection of a spring member.

5. The opening assembly of claim 3 further comprising:

a lug secured to the trigger sleeve; and a lug pathway inscribed in the central valve mandrel, within which the lug is disposed for movement.

6. The opening assembly of claim 1 wherein the central valve mandrel further comprises a valve seat for engaging an axial side of the flapper member in the closed position.

7. A flapper valve assembly comprising:

a central valve mandrel defining an axial flowbore;

a flapper valve member disposed within the flowbore and having a first axial side and a second axial side, the flapper valve member being moveable between a closed position, wherein the flapper member blocks fluid flow through the flowbore, and an open position, wherein fluid may flow through the flowbore;

first valve seat for engaging the first axial side of the flapper valve member when in the closed position;

an opening sleeve that is axially moveable with respect to the valve mandrel for contacting the closed flapper valve member and moving it from its closed position to its open; and a second valve seat for engaging the second axial side of the flapper member when in the closed position to secure the flapper member against pressure differentials from either axial side.

8. The flapper valve assembly of claim 7 wherein the opening sleeve presents an opening shoulder for engaging a portion of the opening sleeve to move it to its open position.

9. The flapper valve assembly of claim 8 wherein the flapper valve member further includes a side lug projecting from an edge surface of the valve member, and wherein the opening shoulder of the opening sleeve engages the side lug to move the valve member to its open position.

10. The flapper valve assembly of claim 7 wherein the opening sleeve is axially moved by a valve opening assembly comprising:

a ratchet mechanism affixed to the opening sleeve and associated with the central valve mandrel for one-way relative movement of the opening sleeve with respect to the central valve mandrel.

11. The flapper valve assembly of claim 10 wherein the valve opening assembly further comprises a trigger sleeve radially surrounding the central valve mandrel and operably associated with the central valve mandrel by a lug and pathway arrangement.

12. The flapper valve assembly of claim 11 further comprising a compression spring interconnecting the trigger sleeve with the ratchet mechanism.

13. The flapper valve assembly of claim 7 wherein:

the flapper valve member includes a pair of side lugs projecting from opposite edge surface of the valve member; and wherein the opening sleeve presents a pair of opening shoulders, and each of the opening sleeve engages one of the side lugs to move the valve member to its open position.

14. The flapper valve assembly of claim 7 wherein the second valve seat is formed into an axial end of the central valve mandrel.

15. A method of operating a flapper valve comprising the steps of:

disposing the flapper valve assembly into a wellbore, the flapper valve member of the flapper valve assembly being in an open position to permit fluid flow through the flowbore;

closing the flapper valve assembly to block fluid flow through the flowbore;

reopening the flapper valve assembly to permit fluid flow through the flowbore, the flapper valve assembly being reopened by axially shifting an opening sleeve to cause an opening shoulder on the opening sleeve to contact a side pin projecting from the flapper valve member and urge the flapper valve member to its open position.

16. The method of claim 15 wherein the opening sleeve is axially shifted by moving a trigger sleeve that is operatively associated with the opening sleeve.

* * * * *

UNITED STATES PATENT AND TRADEMARK OFFICE

CERTIFICATE OF CORRECTION

PATENT NO. : 7,270,191 B2
APPLICATION NO. : 11/099938
DATED : September 18, 2007
INVENTOR(S) : Drummond et al.

It is certified that error appears in the above-identified patent and that said Letters Patent is hereby corrected as shown below:

Column 5, line 27, claim 7, the phrase "its open; and" should read --its open position; and--

Signed and Sealed this

Fourth Day of December, 2007

JON W. DUDAS
*Director of the United States Patent and Trademark Office*